US009153407B2

(12) United States Patent
Jeong et al.

(10) Patent No.: US 9,153,407 B2
(45) Date of Patent: Oct. 6, 2015

(54) X-RAY TUBE

(71) Applicant: Electronics and Telecommunications Research Institute, Daejeon (KR)

(72) Inventors: Jin Woo Jeong, Daejeon (KR); Yoon-Ho Song, Daejeon (KR); Sungyoul Choi, Ulsan (KR); Jun Tae Kang, Daegu (KR); Jae-woo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 8 days.

(21) Appl. No.: 14/099,201

(22) Filed: Dec. 6, 2013

(65) Prior Publication Data

US 2014/0161232 A1 Jun. 12, 2014

(30) Foreign Application Priority Data

Dec. 7, 2012 (KR) ..... 10-2012-0142279
Oct. 18, 2013 (KR) ..... 10-2013-0124816

(51) Int. Cl.

*H01J 35/06* (2006.01)
*H01J 35/10* (2006.01)
*H01J 35/30* (2006.01)
*H01J 35/14* (2006.01)

(52) U.S. Cl.

CPC ..... *H01J 35/065* (2013.01); *H01J 35/305* (2013.01); *H01J 35/14* (2013.01); *H01J 2201/30469* (2013.01); *H01J 2235/068* (2013.01)

(58) Field of Classification Search

CPC ..... H01J 35/14; H01J 35/30; H01J 35/08; H01J 2235/086; H01J 35/02; H01J 35/04; H01J 2235/068; H01J 35/10; H01J 2235/02; H01J 2235/082; H01J 2235/087; H01J 2235/1212; H01J 2235/1216; H01J 2201/30469; H01J 35/065; H01J 35/305

USPC ..... 378/124, 137, 138, 143, 144

See application file for complete search history.

(56) References Cited

U.S. PATENT DOCUMENTS 4,993,055 A * 2/1991 Rand et al. ..... 378/125
6,181,771 B1 * 1/2001 Hell et al. ..... 378/137
2009/0016489 A1 1/2009 Danz (Continued)

FOREIGN PATENT DOCUMENTS

JP 2001319608 A 11/2001
KR 1020080005377 A 1/2008

*Primary Examiner* — Irakli Kiknadze

(74) *Attorney, Agent, or Firm* — William Park & Associates Ltd.

(57) ABSTRACT

An X-ray tube is provided. The X-ray tube includes a first housing including an X-ray window formed therein, a second housing being rotatable about a rotational shaft installed within the first housing, an anode installed on the rotational shaft within the second housing and positioned in one side of the rotational shaft in an extending direction of the rotational shaft, an emitter installed on the rotational shaft within the second housing, positioned in the other side of the rotational shaft in the extending direction of the rotational shaft, and emitting electron beams, a lens unit installed between the anode and the emitter and focusing the electron beams emitted from the emitter to the anode, and an electron beam deflection unit installed on the rotational shaft to deflect an angle of electron beams moving toward the anode from the lens unit.

12 Claims, 7 Drawing Sheets

(56) References Cited

U.S. PATENT DOCUMENTS

2010/0080359 A1* 4/2010 Sakabe ..... 378/131
2010/0195799 A1* 8/2010 Tomita et al. ..... 378/138
2012/0099708 A1* 4/2012 Rogers et al. ..... 378/138
2012/0163530 A1* 6/2012 Sainath et al. ..... 378/5
2012/0257722 A1 10/2012 Heidrich
2012/0269326 A1* 10/2012 Adler et al. ..... 378/138

* cited by examiner

X-RAY TUBE

CROSS-REFERENCE TO RELATED APPLICATION

This application claims priority to and the benefit of Korean Patent Application Nos. 10-2012-0142279 and 2013-0124816 filed in the Korean Intellectual Property Office on Dec. 7, 2012 and Oct. 18, 2013, the entire contents of which are incorporated herein by reference.

BACKGROUND OF THE INVENTION (a) Field of the Invention

The present invention relates to an X-ray tube.

(b) Description of the Related Art

An X-ray tube uses principle the fact that when a high voltage is applied between a cathode and an anode, a thermal electron source generated in the cathode configured as a filament collides with the anode as a metal to collide with electrons of the metal, producing X rays.

The interior of the X-ray tube is maintained in a vacuum state to prevent molecular ionization in a movement path of high energy electron beams, thus preventing damage to the electron source due to dielectric breakdown or ion collision. A thickness of a target is determined in consideration of a transmission depth of electrons and absorption capability of heat generated by the target.

Here, in the X-ray tube, electrons emitted from the cathode are accelerated in the vacuum state to collide with the anode target, about 1% of electron energy is generated as X rays and about 99% of energy becomes heat energy according to bremsstrahlung, and thus an allowable thermal load of the anode target is directly related to an output of an X-ray source.

Meanwhile, an X-ray tube is divided into a fixed X-ray tube and a rotational X-ray tube according to a way in which an anode operates. A rotational X-ray tube is substantially the same as a fixed X-ray tube, except for a function of dispersing heat generated by a target according to rotation of an anode.

FIG. 1 is a view illustrating a rotational X-ray tube according to the related art. Referring to FIG. 1, the related art X-ray tube employs a thermal electron source and a magnetic electron lens, in which a vacuum container 2 having a thermal electron source at the left is positioned within a container 1 filled with cooling insulating oil, and supports a bearing 6 to allow a rotational shaft 3 to rotate.

A path of electron beams emitted from the thermal electron source is bent due to a magnetic lens 5 outside of the vacuum container 2 to reach a sloped anode 4 target, producing X rays. The related art X-ray tube is advantageous in that the rotary anode 4 may effectively release (or dissipate) heat through the cooling insulating oil.

However, X-rays cannot be switched at a desired time due to a limitation in the thermal electron source.

SUMMARY OF THE INVENTION

The present invention has been made in an effort to provide an X-ray tube having advantages of controlling strength and an emission time of X-rays by using a field emitter as an electron source, and effectively releasing heat generated by an anode.

An exemplary embodiment of the present invention provides an X-ray tube including: a first housing including an X-ray window formed therein; a second housing being rotatable about a rotational shaft installed within the first housing; an anode installed on the rotational shaft within the second housing and positioned in one side of the rotational shaft in an extending direction of the rotational shaft; an emitter installed on the rotational shaft within the second housing, positioned in the other side of the rotational shaft in the extending direction of the rotational shaft, and emitting electron beams; a lens unit installed between the anode and the emitter and focusing the electron beams emitted from the emitter to the anode; and an electron beam deflection unit installed on the rotational shaft to deflect an angle of electron beams moving toward the anode from the lens unit.

The anode, the emitter, the lens unit, and the electron beam deflection unit may be rotated about the rotational shaft together with the second housing.

The anode may have sloped surfaces formed to be symmetrical with respect to the rotational shaft so that a cross-section of the anode in the extending direction of the rotational shaft has a trapezoidal shape.

The emitter may include a nano material emitter.

The emitter may be formed in plural, and the plurality of emitters may be disposed radially about the rotational shaft.

When any one of the plurality of emitters is aligned with the X-ray window, electron beams are induced, and the induced electron beams are accelerated to the anode, producing X-rays.

The electron beam deflection unit may be positioned between the lens unit and the anode.

The electron beam deflection unit may be positioned between the lens unit and the emitter.

A region of the sloped surface of the surface of the anode that the electron beams reach after being deflected by the electron beam deflection unit may have a ring-like shape.

The electron beam deflection unit may have a plurality of electrostatic deflection plates each having a different phase difference, and the plurality of electrostatic deflection plates may be alternately positioned between the plurality of emitters about the rotational shaft.

When the second housing rotates, electrons may be sequentially emitted from the plurality of emitters upon being synchronized with a speed at which the second housing rotates.

Electrons emitted from each of the plurality of emitters may have a continuous pulse form.

In the case of the X-ray tube according to an embodiment of the present invention, strength and an emission time of X-rays can be accurately controlled by using a field emitter as an electron source.

Also, in the case of the X-ray tube according to an embodiment of the present invention, since the anode immersed in the cooling insulating oil is rotated together with the vacuum container, the anode can be effectively cooled.

DETAILED DESCRIPTION OF THE EMBODIMENTS

Figure 1:
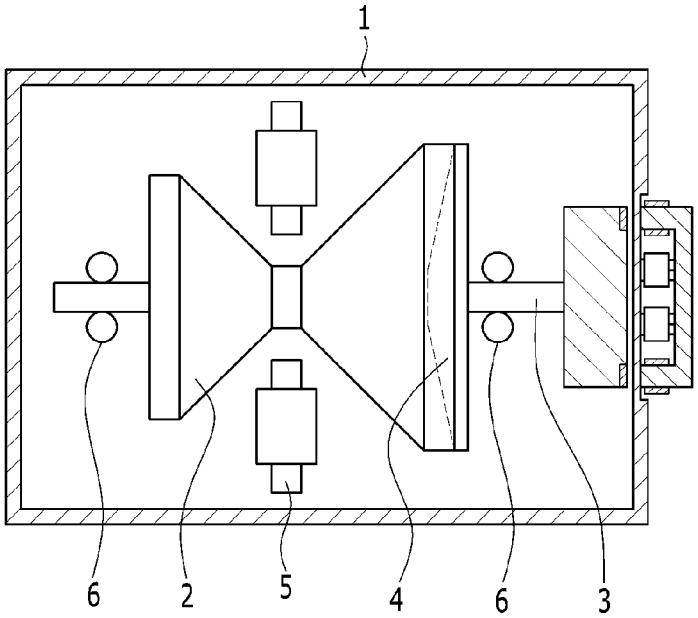
FIG. 1 (PRIOR ART)
FIG. 1 is a view illustrating a rotational X-ray tube according to the related art.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Also, in various embodiments, the same reference numerals are used for components having the same configurations, and a first embodiment will be representatively described and only different configurations of other embodiments will be described.

To clarify the present invention, descriptions of irrelevant portions are limited, and like numbers refer to like elements throughout the specification.

Throughout this specification and the claims that follow, when it is described that an element is "coupled" to another element, it can be directly connected to the other element. In addition, unless explicitly described to the contrary, the word "comprise" and variations such as "comprises" or "comprising" will be understood to imply the inclusion of stated elements but not the exclusion of any other elements.

An X-ray tube according to an embodiment of the present invention is devised to relatively accurately control strength and an emission time of X-rays.

Hereinafter, the X-ray tube according to an exemplary embodiment of the present invention will be described in detail with reference to the accompanying drawings.

Figure 2:
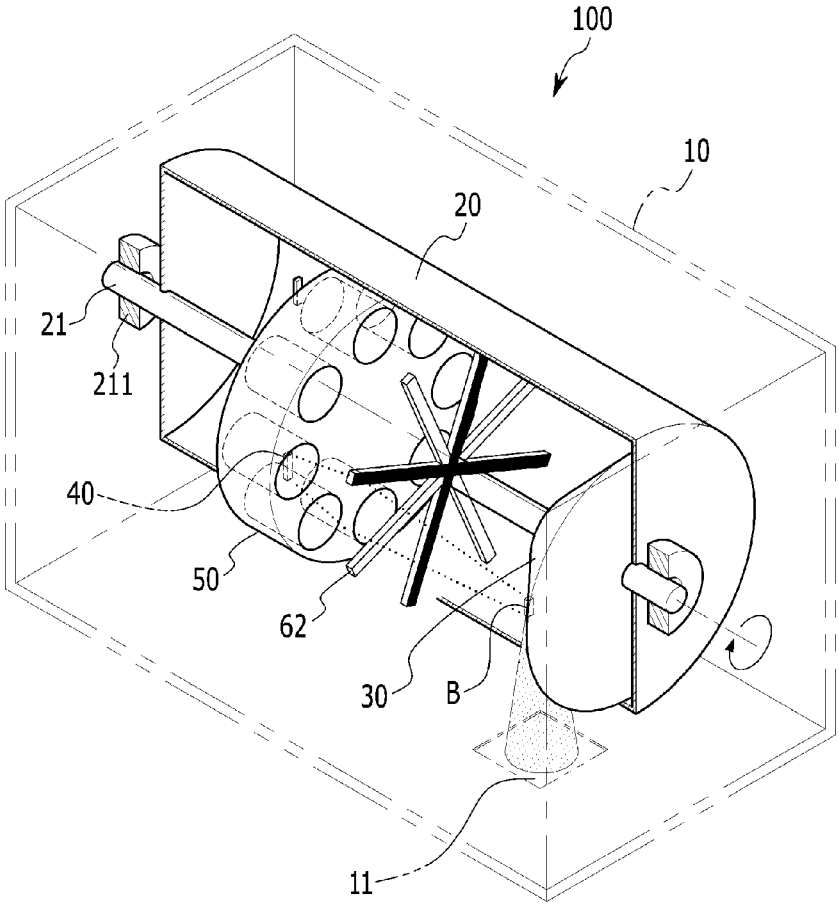
FIG. 2 is a perspective view of an X-ray tube according to an embodiment of the present invention.

FIG. 2 is a perspective view of an X-ray tube 100 according to an embodiment of the present invention.

Referring to FIG. 2, the X-ray tube 100 according to an embodiment of the present invention may include a first housing 10, a second housing 20, an anode 30, an emitter 40, a lens unit 50, and an electron beam deflection unit 62.

First, as illustrated in FIG. 2, in the X-ray tube 100 according to an embodiment of the present invention, the first housing 10 is a constituent element in which the second housing 20, the anode 30, the emitter 40, the lens unit 50, and the electron beam deflection unit 62 as described hereinafter are installed.

In FIG. 2, the first housing 10 is illustrated to have a hexahedral shape, but the present inventive concept is not limited thereto.

Here, the interior of the first housing 10 may be filled with cooling insulating oil to allow the installed elements to be maintained in a cooled and insulated state.

An X-ray window 11 is formed in one side of the first housing 10.

Here, the X-ray window 11 serves to irradiate X-rays produced from a surface of the anode 30 as described hereinafter, as continuous X-rays in a pulse form.

The second housing 20 is installed within the first housing as mentioned above.

In the X-ray tube 100 according to an embodiment of the present invention, as illustrated in FIG. 2, the second housing 20 is a constituent element in which the anode 30, the emitter 40, the lens unit 50, and the electron beam deflection unit 62 as described hereinafter are installed.

In detail, referring to FIG. 2, the second housing 20 may have a cylindrical shape.

Here, the interior of the cylindrical shape is maintained in a vacuum state.

Also, the second housing 20 may be configured to rotate about a rotational shaft 21 (by being centered thereon) extending to traverse a central portion thereof in a length direction.

Here, bearings 211, or the like, may be fixedly installed at outer sides of both ends of the second housing 20 in order to rotate the rotational shaft 21.

Here, the bearings 211 serve to fix the second housing 20 in a predetermined position and rotate the second housing 20 while supporting a load applied to the second housing 20.

Here, the bearings 211 may include a bearing fixed to one side of the second housing 20 and a bearing fixed to the other side of the second housing 20, thereby uniformly rotating the second housing 20.

The anode 30 is installed within the second housing 20.

Here, the anode 30 may be positioned on one side of the rotational shaft 21 in an extending direction of the rotational shaft, and installed on the rotational shaft 21 to rotate about the rotational shaft 21.

According to an embodiment of the present invention, the anode 30 may have sloped surfaces formed to be symmetrical with respect to the rotational shaft 21 so that a cross-section of the anode 30 in the extending direction of the rotational shaft 21 has a trapezoidal shape.

Referring to FIG. 2, the anode 30 may have a circular truncated conical shape.

Electron beams emitted from the emitter 40 as described hereinafter are focused on edge portions as sloped surfaces of the anode 30.

The emitter 40, together with a gate inducing electrons, is installed on the other side of the extending direction of the rotational shaft 21 within the second housing 20.

The emitter 40, an element for emitting electron beams, may be installed on the rotational shaft 21 and rotate about the rotational shaft 21.

The emitter 40 may be a thermionic emission-type hot cathode, a field emission-type cold cathode, and the like, and in an embodiment of the present invention, the emitter 40 is a field emission-type emitter including a nano material emitter such as carbon nano-tubes (CNT).

Hereinafter, the principle of irradiating X-rays will be briefly described.

When a voltage is applied between an anode and an emitter, a field is formed in the emitter, and electrons are emitted from the emitter along the field.

In general, an electron emission mechanism includes thermionic emission, field emission, and the like.

Electrons emitted from the emitter collide with the anode formed to be spaced apart from the emitter at a predetermined interval, producing X-rays, and the produced X-rays are irradiated through an X-ray window.

In the X-ray tube 100 according to an embodiment of the present invention, the emitter 40 may be provided in plural, and the plurality of emitters 40 may be disposed radially around the rotational shaft.

When one of the plurality of emitters 40 is aligned with the X-ray window 11, electron beams are induced from the emitter 40, and the induced electron beams are accelerated to the anode 30, producing X-rays.

In detail, as the second housing 20 rotates, the anode 30, the emitter 40, the lens unit 50, and the electron beam deflection unit 62 are synchronized according to a rotation speed of the second housing 20, allowing electron beams to be sequentially emitted from the emitter 40. The emitted electron beams produce X-rays from the surface of the anode 30. The produced X-rays are irradiated as continuous X-rays in a pulse form through the X-ray window 11.

Meanwhile, the lens unit 50 is installed between the anode 30 and the emitter 40.

The lens unit 50, an element serving to focus electron beams emitted from the emitter 40 to a particular region of the anode 30, is installed on the rotational shaft 21 to rotate about the rotational shaft 21.

Referring to FIG. 2, in the X-ray tube 100 according to an embodiment of the present invention, the lens unit 50 may be installed to correspond to the position in which the plurality of emitters 40 are disposed in the edge portions of the cylindrical housing.

Also, the electron beam deflection unit 62 may be installed on the rotational shaft 21 to rotate about the rotational shaft 21.

The electron beam deflection unit 62 is an element for deflecting an angle of electron beams moving toward the anode 30 from the lens unit 50.

Referring to FIG. 2, in the X-ray tube 100 according to an embodiment of the present invention, the electron beam deflection unit 62 may be positioned between the lens unit 50 and the anode 30.

Although not shown, the electron beam deflection unit 62 may also be positioned between the emitter 40 and the lens unit 50.

Hereinafter, a detailed configuration of the electron beam deflection unit 62 of the X-ray tube 100 according to an embodiment of the present invention will be described with reference to the accompanying drawings.

Figure 3:
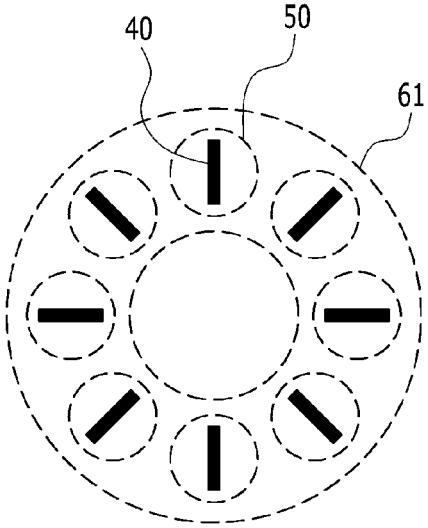
FIG. 3 is a view illustrating an embodiment of a layout of an emitter, a lens unit, and an electron beam deflection unit.
Figure 4:
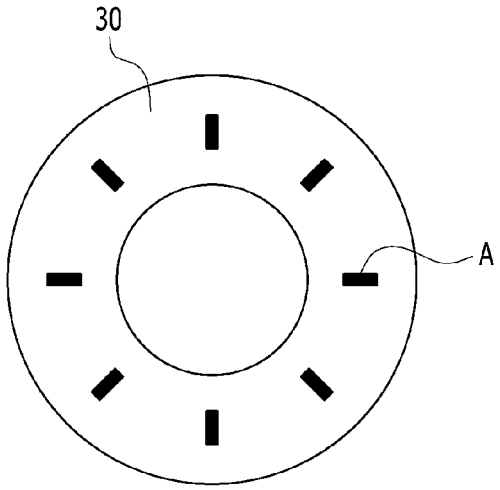
FIG. 4 is a view illustrating regions of an anode that electron beams generated through the layout of FIG. 3 reach.

FIG. 3 is a view illustrating an embodiment of a layout of the emitter 40, the lens unit 50, and the electron beam deflection unit 61. FIG. 4 is a view illustrating regions of the anode that electron beams generated through the layout of FIG. 3 reach.

Figure 5:
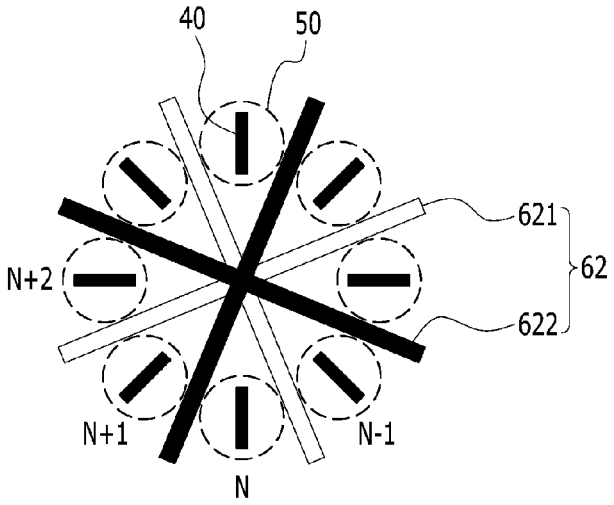
FIG. 5 is a view illustrating a layout of the emitter, the lens unit, and the electron beam deflection unit in the X-ray tube according to an embodiment of the present invention.
Figure 6:
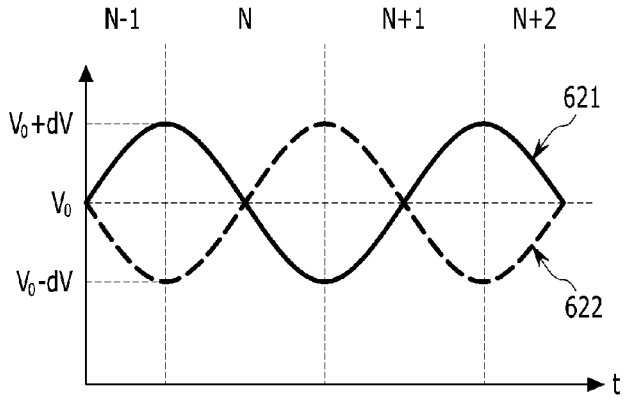
FIG. 6 is a view illustrating that electron beams emitted from the emitter are deflected in each section when the electron beam deflection unit includes first and second electrostatic deflection plates in the X-ray tube according to an embodiment of the present invention.
Figure 7:
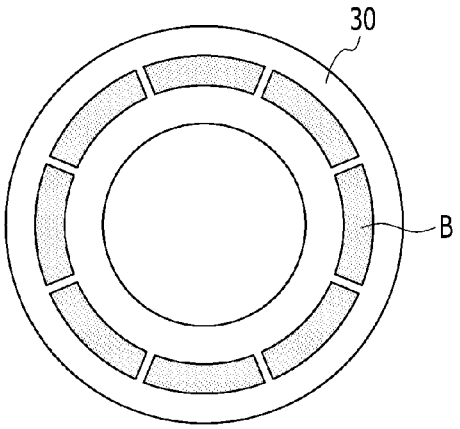
FIG. 7 is a view illustrating regions of the anode that the electrons generated through the layout of FIG. 5 reach.

FIG. 5 is a view illustrating a layout of the emitter 40, the lens unit 50, and the electron beam deflection unit 62 in the X-ray tube according to an embodiment of the present invention. FIG. 6 is a view illustrating that electron beams emitted from the emitter 40 are deflected in each section when the electron beam deflection unit 62 includes first and second electrostatic deflection plates 621 and 622 in the X-ray tube according to an embodiment of the present invention. FIG. 7 is a view illustrating regions of the anode that the electrons generated through the layout of FIG. 5 reach.

First, a cross-section of the emitter 40, the lens unit 50, and the electron beam deflection unit 61 is illustrated in FIG. 3 according to an embodiment of a layout thereof.

As described above, as the second housing 20 rotates, the anode 30, the emitter 40, the lens unit 50, and the electron beam deflection unit 61 rotate uniformly, and in this case, when a particular emitter 50 is aligned with the X-ray window 11, electron beams are induced from the emitter 50 and the induced electron beams are accelerated to the anode 30, producing X-rays.

When it is assumed that the foregoing layout is applied to the X-ray tube according to an embodiment of the present invention, the emitter 50, the lens unit 50, and the electron beam deflection unit 61 are aligned, as illustrated in FIG. 3.

Here, the electron beam deflection unit 61 is configured to have a ring-like shape such that a thickness of an edge thereof is slightly greater than widths of the emitter 40 and the lens unit 50.

When the electron beam deflection unit 61 is configured as illustrated in FIG. 3, electron beams may reach only a partial region A of the anode 30 as illustrated in FIG. 4.

Thus, it is difficult to effectively dissipate heat generated from the surface of the anode 30.

Thus, in the X-ray tube according to an embodiment of the present invention, the emitter 40, the lens unit 50, and the electron beam deflection unit 62 are disposed as illustrated in FIG. 5.

In detail, referring to FIG. 5, the emitter 40 and the lens unit 50 are positioned to be aligned.

As illustrated in FIG. 5, the electron beam deflection unit 62 includes a first electrostatic deflection plate 621 and a second electrostatic deflection plate 622 each having a different phase difference and having a plate-like shape. The first electrostatic deflection plate 621 and the second electrostatic deflection plate 622 are alternately positioned between the emitters 40 around the rotational shaft.

As mentioned above, as the second housing 20 rotates, the anode 30, the emitter 40, the lens unit 50, and the electron beam deflection unit 62 are rotated uniformly according to a rotation speed of the second housing 20, and in this case, when the emitter 50, in synchronization with the rotation speed of the second housing 20, is aligned with the X-ray window 11, electrons are sequentially emitted from the emitter 40.

Here, the electrons emitted from the emitter 40 may have a continuous pulse form.

The emitted electron beams are focused by the lens unit 50 and synchronized with the rotation speed of the second housing 20, whereby a trace of the electron beams is shifted by the electron beam deflection unit 62.

In detail, referring to FIGS. 5 and 6, when the X-ray window 11 is positioned between (N−1)th emitter 40 and Nth emitter 40, electron beams emitted from the Nth emitter 40 reach a surface of the anode 30 facing the position between the Nth emitter 40 and the (N−1)th emitter 40 by the first electrostatic deflection plate 621 having a high voltage and the second electrostatic deflection plate 622 having a low voltage, as illustrated in FIG. 6.

The second housing 20 continues to rotate, and when the Nth emitter 40 reaches the position of the X-ray window 11, the first electrostatic deflection plate 621 and the second electrostatic deflection plate 622 have the same voltage, so deflection does not take place and electron beams emitted from the Nth emitter 40 directly reach the anode 30.

When the second housing 20 rotates further, electron beams reach a surface of the anode 30 facing a boundary portion of (N+1)th emitter 40.

In this manner, although electrons are sequentially emitted from the respective emitters 40, the effect that electrons successively reach the sloped portion of the surface of the anode 30, i.e., the circumferential surface of the anode 30, due to deflection of electron beams can be obtained.

In the X-ray tube according to an embodiment of the present invention, in the case in which the electron beam deflection unit 62 is configured as illustrated in FIG. 5, electron beams may reach a wide region B of the anode 30 in a ring shape as illustrated in FIG. 7.

Thus, the heating area of the surface of the anode 30 can be advantageously increased. In FIG. 7, in order to describe the relationship between FIGS. 5 and 6, it is illustrated that electron beam arrival regions are spaced apart from one another, but preferably, the electron beam arrival regions have a continuous ring shape with a space therein.

Through the foregoing configuration, the X-ray tube according to an embodiment of the present invention can control strength and an emission time of X-rays and effectively dissipate heat generated by the anode.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

| | |
|---|---|
| 1: container | 2: vacuum container |
| 3: rotational shaft | 4: anode |
| 5: magnetic lens | 6: bearing |
| 10: first housing | 11: X-ray window |
| 20: second housing | 21: rotational shaft |
| 211: bearing | 30: anode |
| 40: emitter | 50: lens unit |
| 61, 62: electron beam deflection unit | |
| 621: first electrostatic deflection plate | |
| 622: second electrostatic deflection plate | |
| A, B: electron beam arrival region | |

What is claimed is:

1. An X-ray tube comprising:

a first housing including an X-ray window formed therein;

a second housing being rotatable about a rotational shaft installed within the first housing;

an anode installed on the rotational shaft within the second housing and positioned in one side of the rotational shaft in an extending direction of the rotational shaft;

an emitter installed on the rotational shaft within the second housing, positioned in the other side of the rotational shaft in the extending direction of the rotational shaft, and emitting electron beams;

a lens unit installed between the anode and the emitter and focusing the electron beams emitted from the emitter to the anode; and an electron beam deflection unit installed on the rotational shaft to deflect an angle of electron beams moving toward the anode from the lens unit.

2. The X-ray tube of claim 1, wherein the anode, the emitter, the lens unit, and the electron beam deflection unit are rotated about the rotational shaft together with the second housing.

3. The X-ray tube of claim 1, wherein the anode has sloped surfaces formed to be symmetrical with respect to the rotational shaft so that a cross-section of the anode in the extending direction of the rotational shaft has a trapezoidal shape.

4. The X-ray tube of claim 3, wherein the electron beam deflection unit is positioned between the lens unit and the anode.

5. The X-ray tube of claim 4, wherein a region of the sloped surface of the surface of the anode that the electron beams reach after being deflected by the electron beam deflection unit has a ring-like shape.

6. The X-ray tube of claim 5, wherein the electron beam deflection unit has a plurality of electrostatic deflection plates each having a different phase difference, and the plurality of electrostatic deflection plates are alternately positioned between the plurality of emitters about the rotational shaft.

7. The X-ray tube of claim 6, wherein when the second housing rotates, electrons are sequentially emitted from the plurality of emitters upon being synchronized with a speed at which the second housing rotates.

8. The X-ray tube of claim 6, wherein electrons emitted from each of the plurality of emitters have a continuous pulse form.

9. The X-ray tube of claim 3, wherein the electron beam deflection unit is positioned between the lens unit and the emitter.

10. The X-ray tube of claim 1, wherein the emitter comprises a nano material emitter.

11. The X-ray tube of claim 1, wherein the emitter is formed in plural, and the plurality of emitters are disposed radially about the rotational shaft.

12. The X-ray tube of claim 11, wherein when any one of the plurality of emitters is aligned with the X-ray window, electron beams are induced, and the induced electron beams are accelerated to the anode, producing X-rays.

* * * * *